US010695603B1

(12) United States Patent
Lamping

(10) Patent No.: US 10,695,603 B1
(45) Date of Patent: Jun. 30, 2020

(54) GRIP AUGMENTATION STRAPS

(71) Applicant: Keith Lamping, Kettering, OH (US)

(72) Inventor: Keith Lamping, Kettering, OH (US)

( * ) Notice: Subject to any disclaimer, the term of this patent is extended or adjusted under 35 U.S.C. 154(b) by 0 days.

(21) Appl. No.: 15/154,972

(22) Filed: May 14, 2016

Related U.S. Application Data

(60) Provisional application No. 62/163,413, filed on May 19, 2015.

(51) Int. Cl.

| | |
|---|---|
| ***A63B 21/00*** | (2006.01) |
| ***A63B 21/078*** | (2006.01) |
| ***A63B 21/072*** | (2006.01) |
| ***A41D 20/00*** | (2006.01) |
| ***A41D 13/08*** | (2006.01) |
| ***A61H 3/00*** | (2006.01) |

(52) U.S. Cl.
CPC ..... *A63B 21/4021* (2015.10); *A41D 13/082* (2013.01); *A41D 20/00* (2013.01); *A61H 3/00* (2013.01); *A63B 21/0724* (2013.01); *A63B 21/0726* (2013.01); *A63B 21/0783* (2015.10); *A41D 2400/82* (2013.01); *A41D 2600/10* (2013.01); *A61H 2003/007* (2013.01)

(58) Field of Classification Search
CPC ..... A63B 21/40; A63B 21/078; A63B 21/072; A41D 13/08; A41D 20/00; A41D 2400/08; A41D 2600/01; A61H 3/00; A61H 2003/00
See application file for complete search history.

(56) References Cited

U.S. PATENT DOCUMENTS

| | | | | |
|---|---|---|---|---|
| 5,628,069 | A * | 5/1997 | Ebert | A41D 19/00 2/160 |
| 6,220,916 | B1 * | 4/2001 | Bart | A63H 33/00 434/393 |
| 8,769,742 | B2 * | 7/2014 | Thornton | A47G 9/062 5/420 |
| 8,776,418 | B1 * | 7/2014 | Martinez | G06F 15/00 40/633 |
| 8,978,667 | B2 * | 3/2015 | Lammon | A45D 44/00 132/200 |
| 9,061,541 | B2 * | 6/2015 | Elmore | B43K 8/003 |
| 9,371,118 | B2 * | 6/2016 | King | B63C 9/00 |
| 9,534,749 | B2 * | 1/2017 | Dai | A44C 5/0053 |
| 9,599,992 | B2 * | 3/2017 | Kohstall | G05D 1/101 |
| 9,844,252 | B2 * | 12/2017 | Kraszewski | A45D 2/127 |

(Continued)

*Primary Examiner* — Garrett K Atkinson
(74) *Attorney, Agent, or Firm* — Gugliotta & Gugliotta LPA

(57) ABSTRACT

A slap wrap style grip augmentation strap is provided in which the extended securing strap is lined with a bistable ribbon formed of metal or similarly functioning material. The lined strap extends from a wrist loop and provide a self-wrapping ability which allows the user to get a tighter and more uniform grip that was previously much harder or near impossible to obtain with other lifting straps. Gripping efficiency is improved with quickly applied, strong and equal equally applied attachment to a targeted piece of exercise equipment. The use of a strap of the present invention will encourage proper body mechanics during lifting exercises that would help prevent these potential dangers. The instant abstract is neither intended to define the invention disclosed in this specification nor intended to limit the scope of the invention in any way.

11 Claims, 15 Drawing Sheets

(56) References Cited

U.S. PATENT DOCUMENTS

| | | | | |
|---|---|---|---|---|
| 9,874,260 | B2 * | 1/2018 | Blochlinger | F16F 1/027 |
| 2010/0192279 | A1 * | 8/2010 | Hunsicker | A41D 19/002<br>2/161.2 |
| 2012/0028737 | A1 * | 2/2012 | Hunsicker | A41D 19/002<br>473/409 |
| 2014/0274614 | A1 * | 9/2014 | Newman | A63B 21/4035<br>482/139 |

* cited by examiner

PRIOR ART

PRIOR ART

PRIOR ART

PRIOR ART

PRIOR ART

PRIOR ART

GRIP AUGMENTATION STRAPS

RELATED APPLICATIONS

The present invention claims the benefit of U.S. Provisional Application 62/163,413 filed on 19 May 2015 and incorporated by reference as if fully rewritten herein.

BACKGROUND OF THE INVENTION

1. Field of the Invention

The present invention relates generally to hand held or hand graspable implements and, more particularly, to an improved strap for enhancing the grip on such items.

2. Description of the Related Art

With many hand graspable or hand held items, a key limitation to effective use may be in how well a user is able to complete or maintain a grip on the item. This is quite apparent for those generally age specific items targeted to the young, whose dexterity and strength has not yet developed, and to the old or infirm whose dexterity and strength have changes or been diminished.

In the field of weight lifting and with similar fitness equipment, limitations to grip are encountered through sheer pushing of the user's physical limits. Lifting straps may be used as an aid to improve the user's grip on a bar and to allow the user to concentrate on the muscles they wish to exercise rather than the ones which would otherwise be used in gripping the bar. Such concentration allows a user to work gross motor and large muscle groups without damaging fine motor skills and weak muscle groups. The result is to enable a person to lift significantly larger weights that would have otherwise been prevented by grip strength.

With the resulting increase lifting ability, the use of a wrist supporting lifting strap subsequently further functions as a prophylactic to various damaging or adverse effects that may result on a user's hands. Decreased callous formation and decreased skin tearing should ensue. A decrease in the risk of acquiring carpel tunnel syndrome should also result. But the most immediate effect is the decrease in the potential risk of injury due to premature or accidental releasing of the weights.

Further still, with increasing weight and resistance levels, the need for balanced muscular exertion is important to preventing a variety of stress related conditions. Muscular imbalance can also contribute to pain and inflammation in a user's elbows, shoulders, and upper and lower back (which are further more susceptible to muscle strain or disc herniation). More serious effects may include pelvic obliquity, improper lower extremity alignment, and lower extremity or back muscle strain and pain.

In ongoing attempts to alleviate the above referenced problems and conditions, some methods and devices are known that incorporate various mechanisms for improving the grip of a user during weightlifting or with the use of fitness equipment. These include the following.

As shown in FIG. 1, a classic lifting strap is shown according to the PRIOR ART in which a wrist strap fits around a user's wrist and extends to a disposed length. The extension is wrapped around the target bar to improve grip. While such a design is economic to make, provides for increased gripping (even while wet such as with acquired perspiration), and can release quickly, such a product is not very quick to apply and does not provide for a balanced left-right gripping operation. Additionally, such straps have an inherent tendency to be utilized with uneven tension since a user will use both hands to wrap the first strap, while having only one hand available to wrap the second strap.

As shown in FIG. 2, a variation of the classic lifting strap is shown according to the PRIOR ART in which a wrist ring is used connected to the disposed strap. Such a design has similar benefits and drawbacks.

As shown in FIG. 3, a lifting strap with hook is shown according to the PRIOR ART in which the strap component is formed of a rigid hook shaped element. While such a design further provides for an equal, quick grip, such a device design can be uncomfortable to use and may result in interference with the rapid releasing of a piece of equipment that may cause unintended handling of a barbell.

As shown in FIG. 4, an alternate variation is shown of the lifting strap with hook design. Since exercise equipment may have bars of different diameters, such hooks may not be well adapted for use with a particular piece of equipment, resulting in an uncomfortable torque or as well as interfere with rapid release in a manner that risks accidental misuse.

As shown in FIG. 5, a harbinger lifting grip device design is shown according to the PRIOR ART in which a wrist ring extends to a disposed strap. Such a design is difficult to utilize with heavy weights and does not provide for increased gripping while wet (such as with acquired perspiration), and can similarly result in a user quickly, or accidentally dropping a barbell or releasing a piece of equipment too rapidly or unintendedly.

Finally, as shown in FIG. 6, a gripping glove as provided Power Grip USA, Inc. of Sorrento, Me. and sold under the a name VERSA GRIP® is shown according to the PRIOR ART. As described in U.S. Pat. No. 5,813,950, such a grip assist device provide a gripping portion that includes a non-slip surface that is pliable and elastomeric, providing a thicker, flexible top end of the gripping portion that comes in direct contact with the weight bar. While this gripping flap can be easily positioned between the bar and lifter's hand or partially positioned around the bar by the tips of the fingers of the same hand, such a design is expensive, and loses gripping friction quickly when wet or sweaty. In addition, while such a design is amenable for use with relatively low loads, it becomes difficult to use when lifting heavy loads or weights.

It is preferable that any strap for enhancing the grip on such weight lifting or fitness equipment be economic to make, provide an easy to apply and even grip, does not stress the user's wrist or generate torque on the gripped surface, is equally effective with heavier weights, and remains effective even if wetted during or between use. Consequently, a need has been felt for providing an improved strap for enhancing the grip on such equipment. Further, a need exists for such a solution that may be adaptable to other conventional uses.

SUMMARY OF THE INVENTION

It is thus an object of the present invention to provide an improved strap for enhancing the hand grip onto objects.

It is another object of the present invention to provide an improved strap for enhancing the grip during weight lifting and with fitness equipment.

It is a feature of the present invention to provide a self strapping and tightening lifting strap.

Briefly described according to a preferred embodiment of the present invention, a "slap wrap" style lifting strap is provided in which the extended securing strap is lined with a steel ribbon, similar in design to a steel tape measure or Venetian blind slat. The lined strap extends from a wrist loop and provide a self-wrapping ability which allows the user to get a tighter and more uniform grip that was previously much harder or near impossible to obtain with other lifting straps. The still ribbon may be enveloped in a tubular web or similar structure forming looped end for attachment about a user's wrist. The loop end may be formed as an extension of said length of strap material that is removably connected by a faster, such as a hook and loop fastener, snaps, stitching or buttons. Gripping efficiency is improved with quickly applied, strong and equal equally applied attachment to a targeted piece of exercise equipment.

The use of a Slap Wraps™ Lifting Straps of the present invention will encourage proper body mechanics during lifting exercises that would help prevent these potential dangers. Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation. While a specific best mode is described and disclosed for the purpose of enablement, it is simultaneously intended that the features, advantages and benefits of the present invention may be readily adapted to other uses that are not herein described in detail. By way of example, and not meant as a limitation, it should be apparent to a person having ordinary skill in the relevant art, in light of the specification as described in detail below, that such a grip augmentation device may be similarly used to improve the functionality of a user's cane or walker or other object. It should be further apparent that other adapted uses abound, and as such the invention herein should be interpreted within a broad range of functional equivalents.

Figure 1:
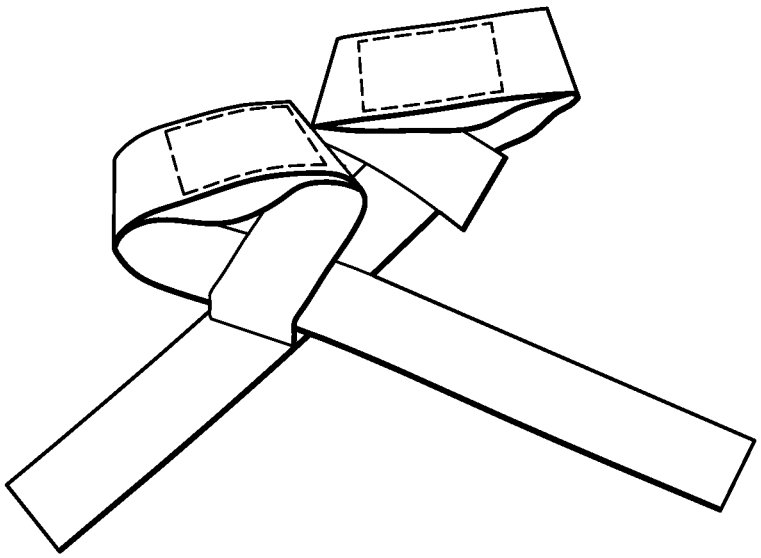
FIG. 1 through FIG. 6 depicts various lifting strap designs according to the PRIOR ART as described above.
Figure 2:
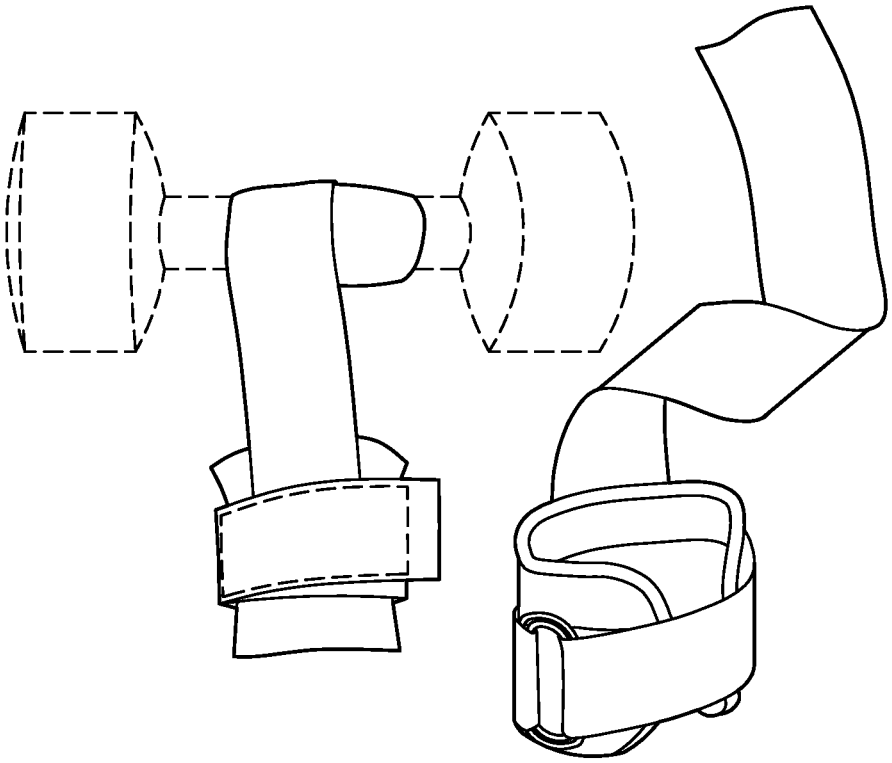
Figure 3:
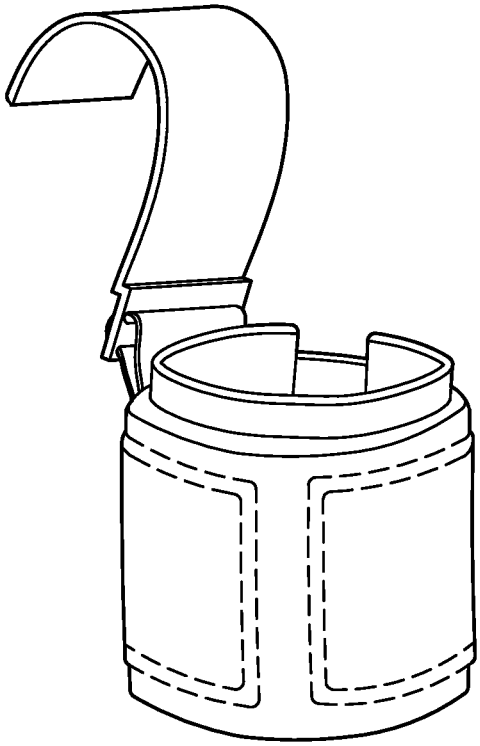
Figure 4:
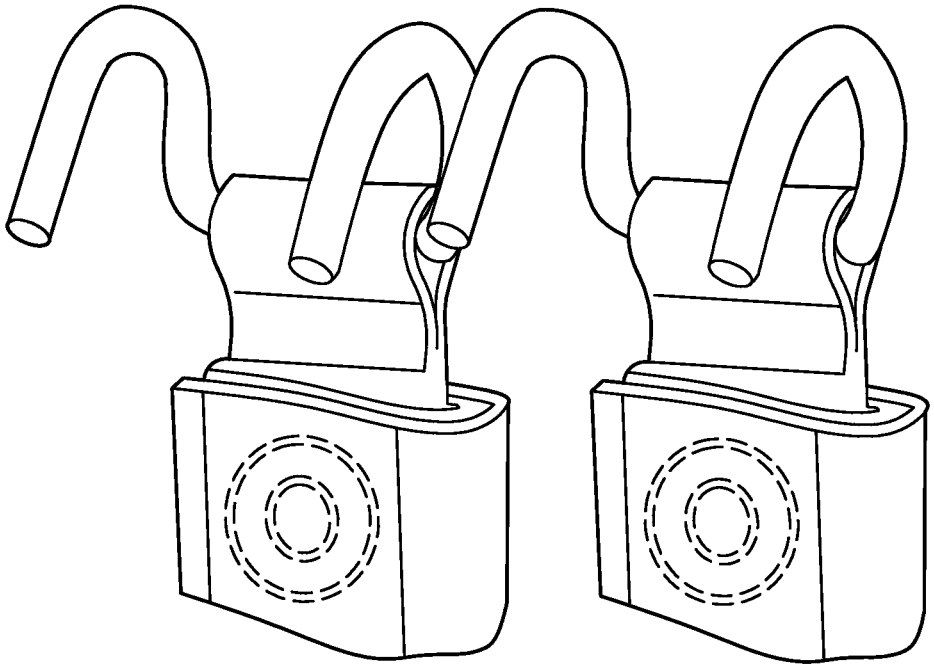
Figure 5:
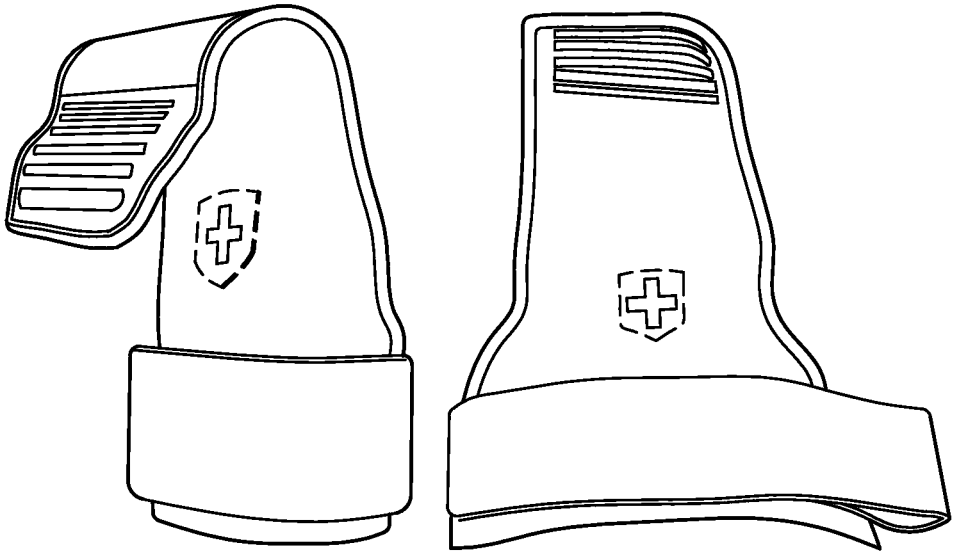
Figure 6:
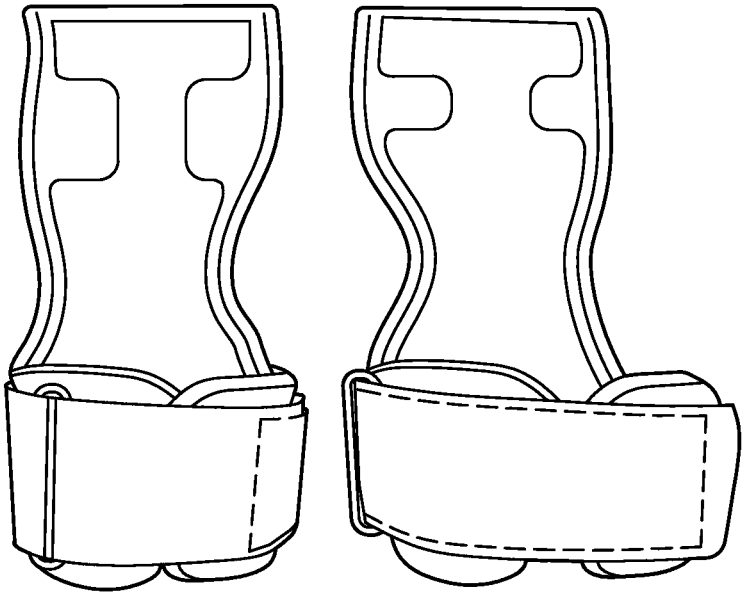
Figure 7A:
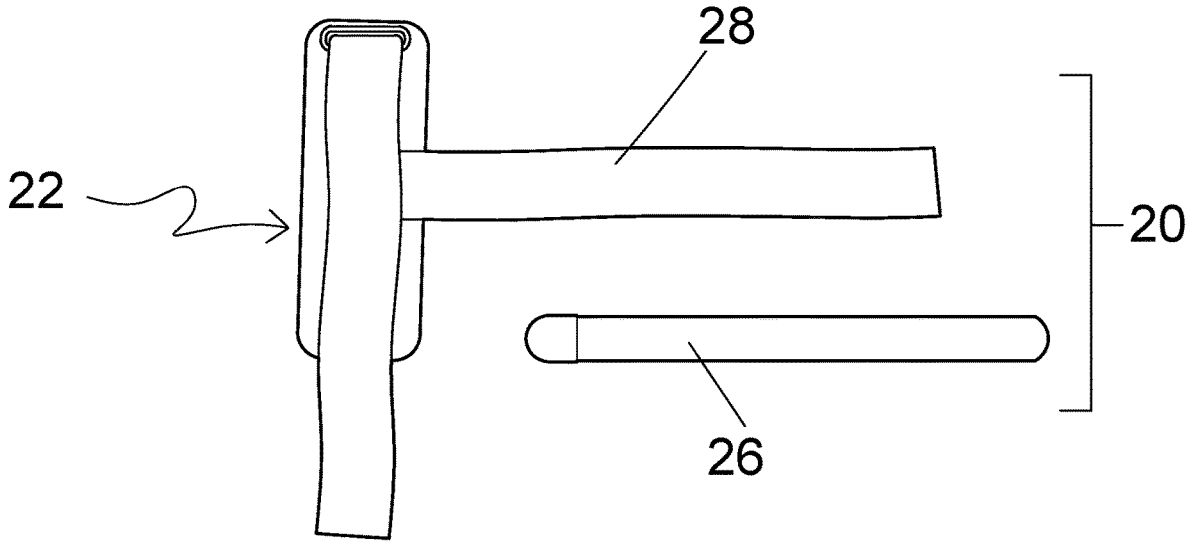
FIG. 7A is a photograph showing a partial exploded plan view of a slap wrap wrist strap according to the preferred embodiment of the present invention including an attachment mechanism.
Figure 7B:
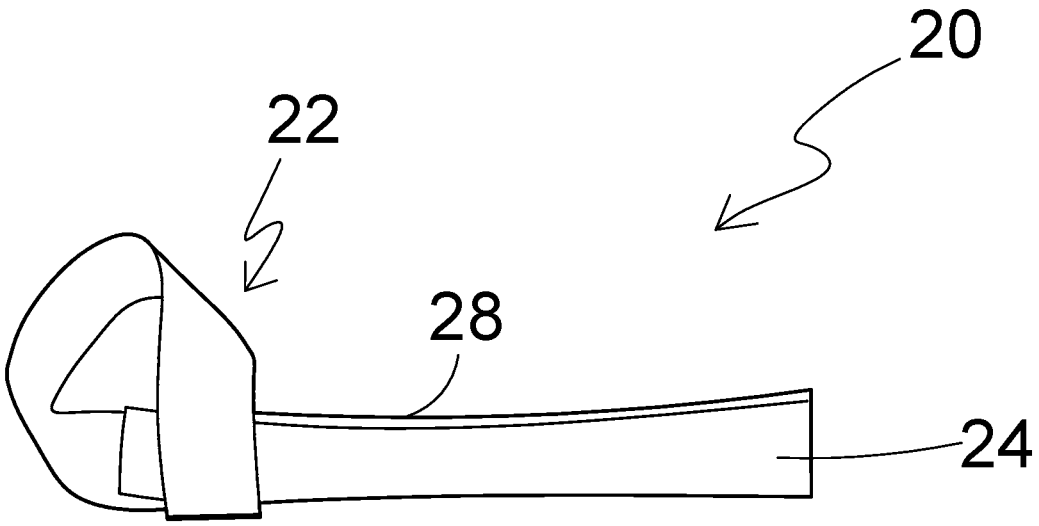
FIG. 7B is a photograph of a completed wrap wrist strap according to an alternate configuration of the preferred embodiment of the present invention utilizing a frictionally impinged loop element.
Figure 8:
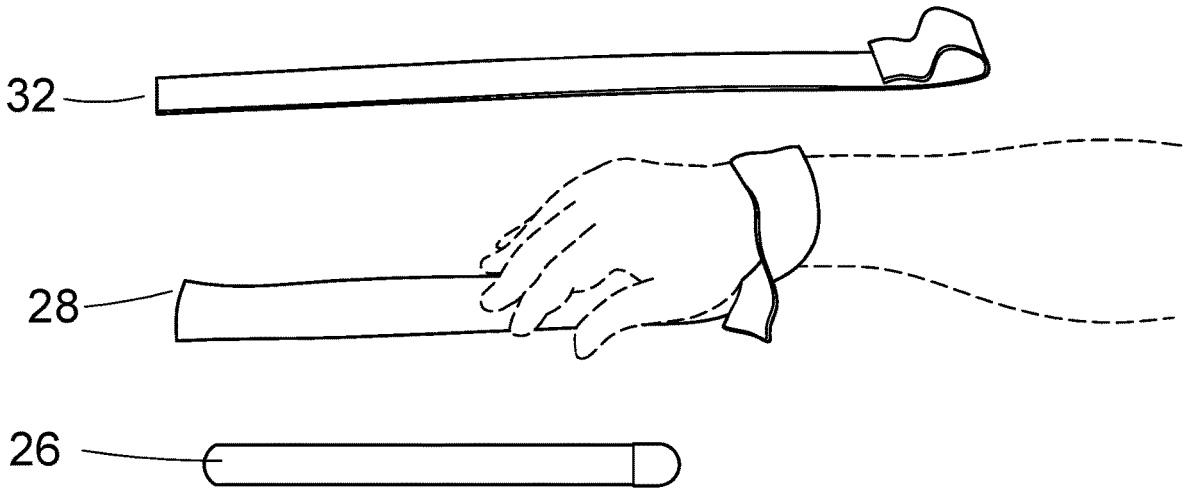
FIG. 8 is a photograph showing the views of 7A and 7B donned onto a wrist of a user.
Figure 9:
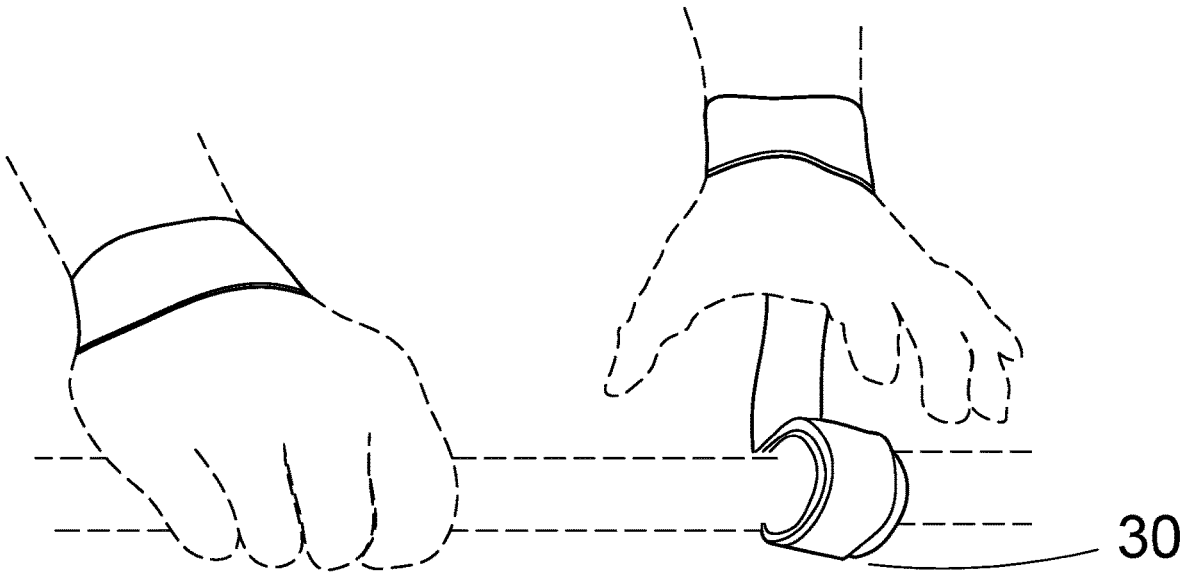
FIG. 9 is a photograph showing the slap wrap wrist strap according to the preferred embodiment of the present invention affixing to a lifting bar of a piece of weight lifting or exercise equipment.
Figure 10:
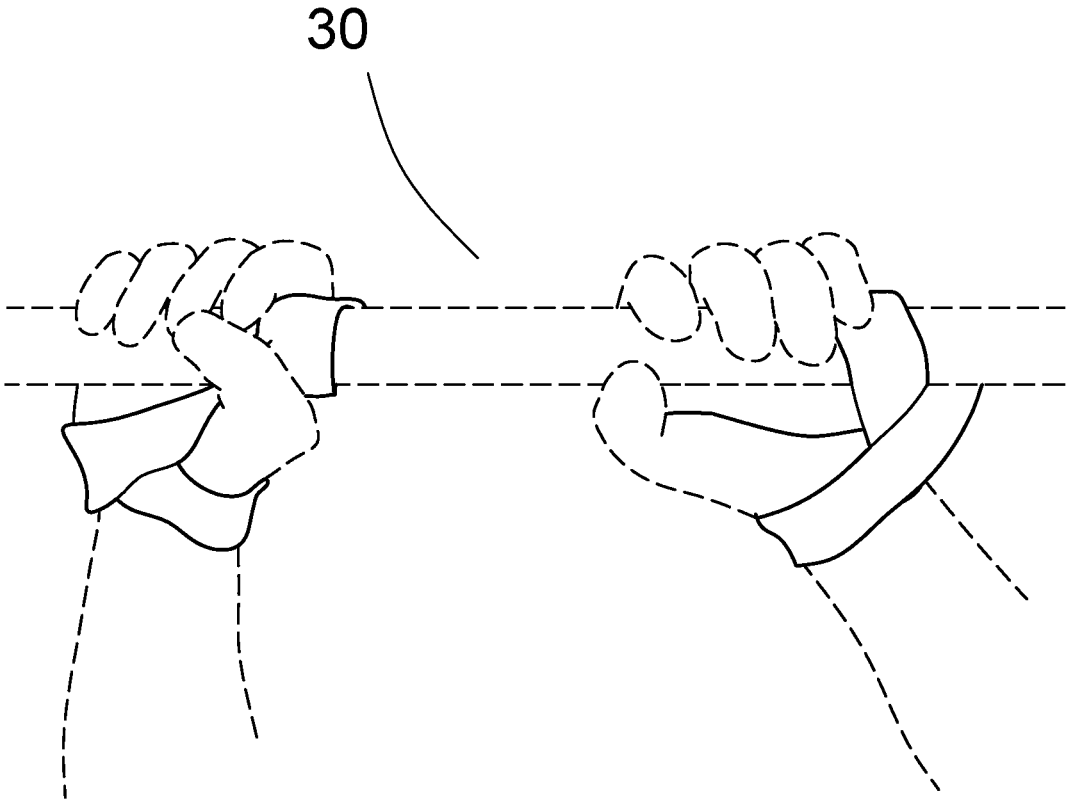
FIG. 10 through FIG. 14 are photographs of the present invention shown in use with various applications.
Figure 11:
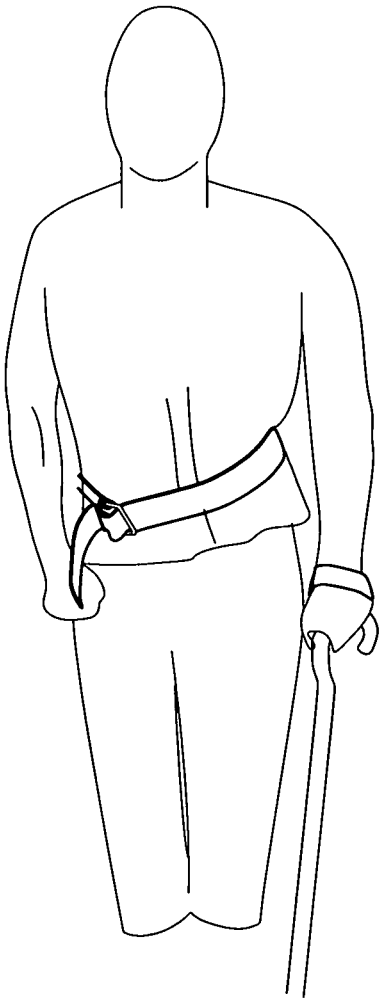
Figure 12:
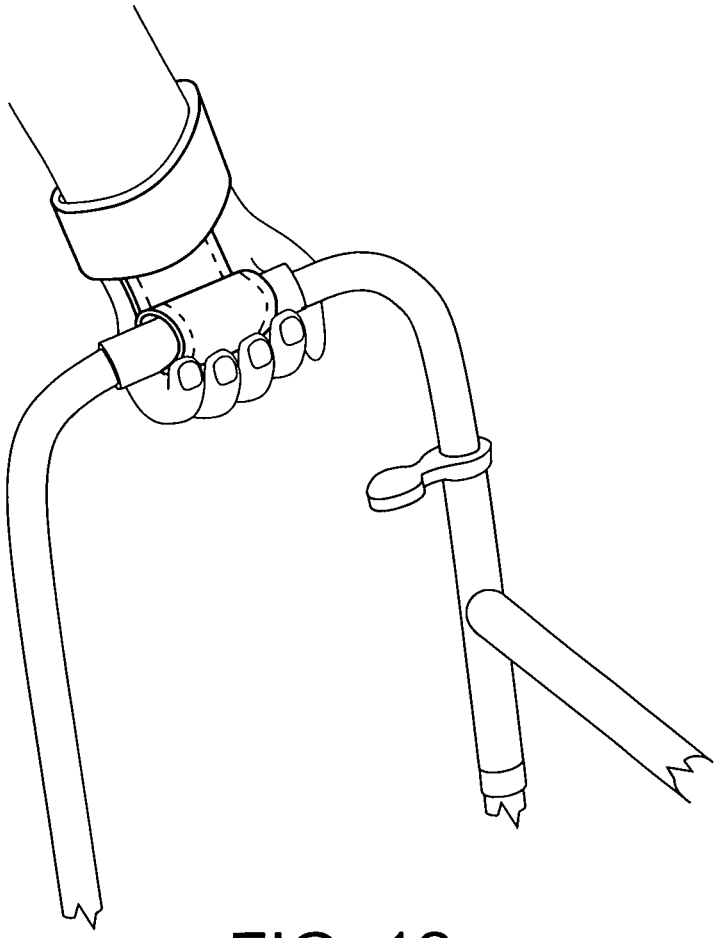

A preferred embodiment of the invention, shown in conjunction with FIG. 7A through FIG. 10, in which a grip augmentation strap, weight lifting wrist straps, generally noted as 20, are shown according to the preferred embodiment of the present invention employed in pairs as weight lifting wrist straps. It should be understood by a person having an ordinary skill in the relevant art, in light of the present teachings, that uses in other applications, either singularly or in pairs, should be considered within the range of equivalents of the present invention. Each strap 20 incorporates a looped band 22 sized in length to fit around and overlap a wrist, forearm or other body part of a user. An elongated attachment strap extension 24 extends laterally outward from the band 22 and is construction of a slap on band in which a bistable metal spring body or band 26 is inserted in and covered by a fabric sleeve 28. The fabric sleeve 28 envelopes the looped band 22 in a tubular structure that entends to form a looped end for attachment about a user's wrist. The loop end may be formed as an extension of said length of strap material that is removably connected by a faster, such as a hook and loop fastener, snaps, stitching or buttons. The bistable metal spring materials may be substituted with alternatives to the metal. The bistable metal spring body 26 is concave when facing up as in FIG. 7. The bistable metal spring body 26 is a bistable spring that has two positions of operation or two states of being. The first state is the elongated position as shown in FIG. 8. In this state the bistable metal spring body retains potential energy. This potential energy will cause the band to coil immediately when the bistable metal body 26 is struck against an object such as the bar of a piece of fitness equipment 30. The second state is the coiled state as shown in FIG. 9-10. The coiled shape in FIG. 9 is shown in the form that the bistable metal spring body 26 will take when slapped around a cylindrical object.

The bistable metal spring body 26, when in the elongated position, is typically greater than 6 inches in length. According to one aspect of the present invention, the spring body 26 may preferably be about between 9 to 12 inches in length. According to another aspect of the present invention, the spring body 26 may preferably between about 7-7½ to 12 inches in length. Typically the width of the bistable metal spring body is 0.5 inches to 1.5 inches in width. However, it should be understood that these dimensions may vary within the overall scope of equivalents of the present invention and the use of any specific dimensions should be considered to be a design choice within the overall scope of the present invention.

The bistable metal spring body 26 may be coated with various types of materials such as fabric, rubber or plastic. As shown according to the preferred embodiment, the spring body 26 is coated by and inserted in a fabric strap sleeve 32 made of a soft and absorbent material such as a cotton or similar fabric. It is preferable for the material coating 24 to be water resistant to protect the bistable metal spring body 26 from rusting, but at the same time should not become overly slippery when wet.

FIGS. 9 and 10 show a preferable attachment method for attaching the strap 28 as a slap-on band to a gripping surface 30 comprising an exercise bar. A bi-stable snap action ribbon spring incorporated into self-latching, spring-loaded mechanisms. The dual mode stability of the spring eliminates the need for complex latching mechanisms thereby simplifying the device manufacture and device reliability. The spring is stable in either a linear or coiled state enabling the simplified design of rolling, hinging and feeding mechanisms.

Figure 13:
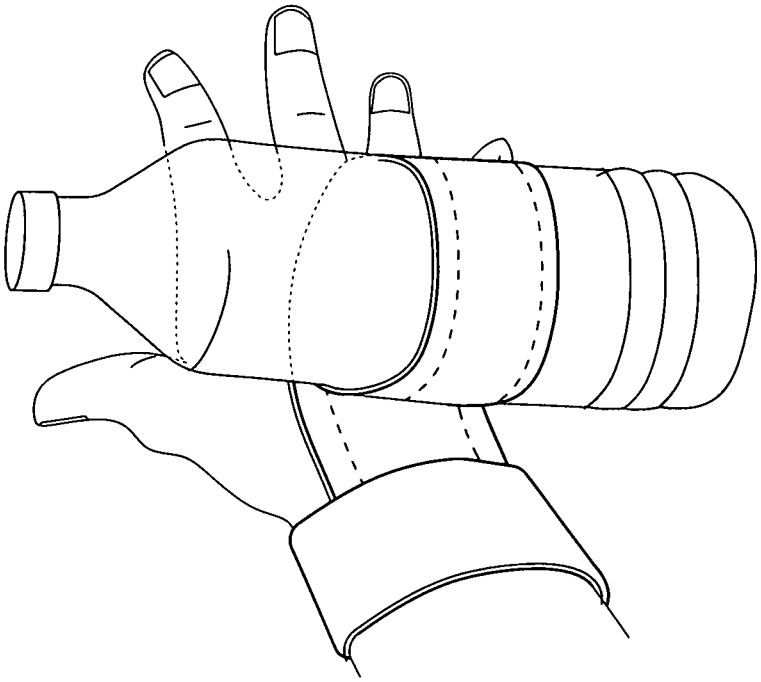
Figure 14:
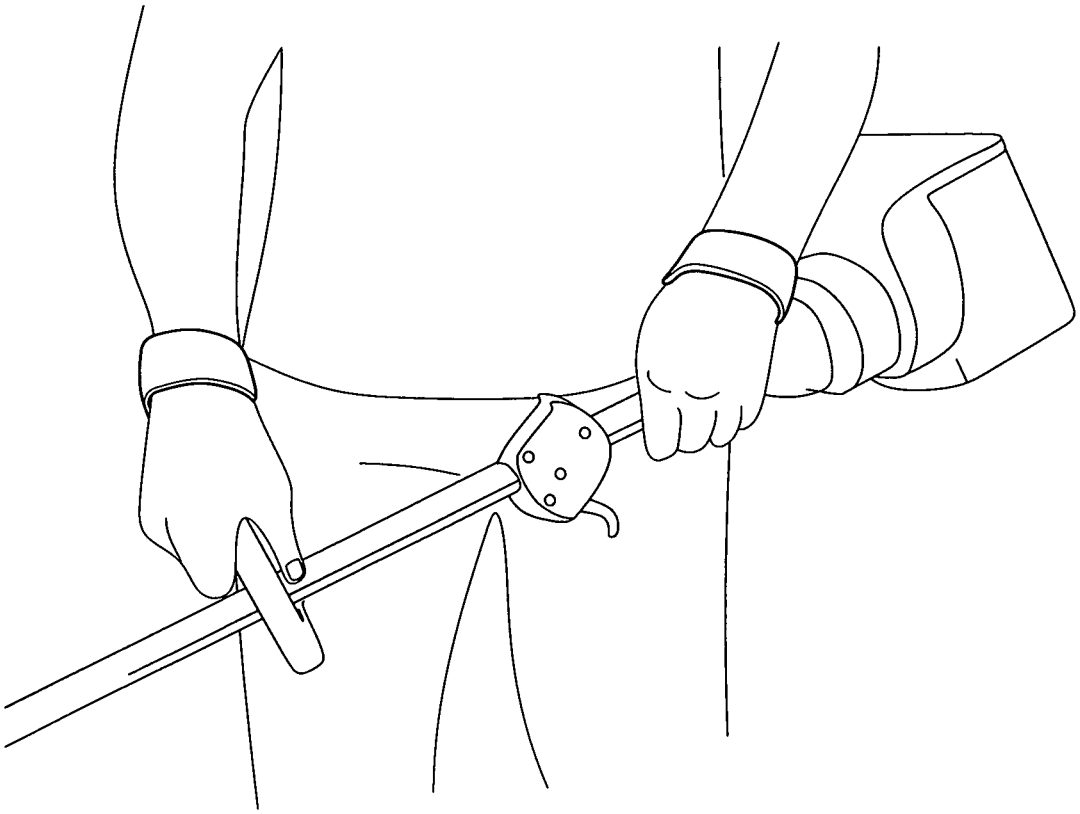

FIGS. 11 through 14 show a preferable attachment method for attaching the strap 28 as a slap-on band to increase the g ripping strength onto various objects. As shown, the present invention may additionally be used to increase the hand-gasping ability of a user onto a cane (FIG. 11), a walker (FIG. 12) or everyday objects such as a water bottle (FIG. 13). Similarly, as shown in conjunction with FIG. 14 a strap 28 may be used in conjunction with a work tool to increase grasping, handling or carrying capability.

2. Operation of the Preferred Embodiment

As shown throughout the Figures and according to the present invention, a commercial embodiment of the present invention offered under the trade name Slap Wraps™ Lifting Straps of the present invention is placed around the user's wrist with the elongated strap extended. When the user approaches a bar or equipment handle, the strap is "snapped" and rolled about the target to provide an increased grip for encouraging proper body mechanics during lifting exercises. The slap on band 20 will then coil and fit to the barbell, securing the slap-on-strap around the wearer's wrist.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar case-law or subsequent precedent should not be made if any future claims are added or amended subsequent to this Patent Application.

What is claimed is:

1. A grip augmentation device consisting essentially of:

a unitary elongated length of strap material having an end for attachment about a user's wrist and an opposite end for coiling, wherein said strap material is comprised in a manner that entirely encompasses a bistable spring mechanism; and at least a portion said length of strap incorporating the entire said bistable spring mechanism for coiling about a member to be gripped;

wherein said end for attachment about a user's wrist comprises a frictionally impinged loop formed as an extension of said length of strap material.

2. The grip augmentation device of claim 1, wherein said loop is removably connected by a fastener.

3. The grip augmentation device of claim 2, wherein said fastener is selected from a group consisting of: hook and loop fastener; snaps; stitching; and buttons.

4. The grip augmentation device of claim 1, wherein said strap material is comprised of tubular webbing.

5. The grip augmentation device of claim 4, wherein said tubular webbing is formed of a fabric material.

6. The grip augmentation device of claim 1, wherein a bistable spring mechanism portion of said strap material is adapted to coil about the member to be gripped, wherein said member to be gripped comprises a handle of a cane or walker.

7. The grip augmentation device of claim 1, wherein the bistable spring portion of said strap material is adapted to coil about the member to be gripped, wherein said member to be gripped comprises a handle of a cane or walker.

8. The grip augmentation device of claim 1, wherein the spring portion of said strap material is adapted to coil about the member to be gripped, wherein said member to be gripped comprises a barbell, dumbbell or other exercise equipment.

9. The grip augmentation device of claim 1, wherein a bistable spring mechanism portion of said strap material is adapted to coil about the member to be gripped, wherein said member to be gripped comprises a barbell, dumbbell or other exercise equipment.

10. A grip augmentation device consisting essentially of:

a first unitary elongated length of strap material having an first end for attachment about a user's left wrist and a first opposite end for coiling, at least a portion said first elongated length of strap incorporating at least a portion of a first bistable spring mechanism for coiling about a member to be gripped; and, in combination a second unitary elongated length of strap material having an second end for attachment about a user's right wrist and a second opposite end for coiling, at least a portion said second elongated length of strap incorporating at least a portion of a second bistable spring mechanism for coiling about the member to be gripped;

wherein said first end for attachment about a user's left wrist and said second end for attachment about a user's right wrist each comprise a frictionally impinged loop formed as an extension of said length of strap material.

11. The grip augmentation device of claim 10, wherein said first end and said second end each comprises said frictionally impinged loop formed as an extension of said length of strap material that is removably connected by a fastener, wherein said fastener is selected from a group consisting of: hook and loop fastener; snaps; stitching; and buttons.

* * * * *